US012601249B2

(12) United States Patent
Johnson

(10) Patent No.: US 12,601,249 B2
(45) Date of Patent: Apr. 14, 2026

(54) DEVICES, SYSTEMS, AND METHODS FOR MITIGATING DOWNHOLE MOTOR DYSFUNCTION

(71) Applicant: Schlumberger Technology Corporation, Sugar Land, TX (US)

(72) Inventor: Ashley Bernard Johnson, Milton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 78 days.

(21) Appl. No.: 18/487,304

(22) Filed: Oct. 16, 2023

(65) Prior Publication Data

US 2024/0133287 A1 Apr. 25, 2024

Related U.S. Application Data

(60) Provisional application No. 63/379,929, filed on Oct. 18, 2022.

(51) Int. Cl.

| | |
|---|---|
| ***E21B 4/02*** | (2006.01) |
| ***E21B 44/00*** | (2006.01) |
| ***E21B 44/06*** | (2006.01) |

(52) U.S. Cl.

CPC ..... *E21B 44/06* (2013.01); *E21B 44/005* (2013.01)

(58) Field of Classification Search

CPC ..... E21B 21/103; E21B 21/08; E21B 4/02

See application file for complete search history.

(56) References Cited

U.S. PATENT DOCUMENTS

| | | | | |
|---|---|---|---|---|
| 5,368,108 | A * | 11/1994 | Aldred | E21B 44/005 175/50 |
| 7,114,581 | B2 * | 10/2006 | Aronstam | E21B 7/128 175/57 |
| 10,900,342 | B2 * | 1/2021 | Belaskie | E21B 21/08 |
| 2009/0173540 | A1 | 7/2009 | Mock | |
| 2012/0097451 | A1 | 4/2012 | Mock | |
| 2018/0038180 | A1 * | 2/2018 | Cramer | E21B 34/08 |
| 2018/0135402 | A1 * | 5/2018 | Jeffryes | E21B 44/06 |
| 2019/0316895 | A1 * | 10/2019 | Ba | F04C 13/008 |
| 2025/0230720 | A1 * | 7/2025 | Payette | E21B 47/008 |

FOREIGN PATENT DOCUMENTS

WO 2019209766 A1 10/2019

* cited by examiner

*Primary Examiner* — Tara Schimpf
*Assistant Examiner* — Ursula Lee Norris
(74) *Attorney, Agent, or Firm* — Jeffrey D. Frantz

(57) ABSTRACT

A drilling system may determine a change in motor torque and/or a pressure drop of a downhole motor based on a flow of a drilling fluid through the downhole motor. The drilling system may determine a change in bit torque of a bit with respect to a change in a weight on bit of the bit. Based at least in part on the change in motor pressure and the change in bit torque of the bit with respect to the change in the weight on bit of the bit, the drilling system may adjust a flow rate of the drilling fluid through the downhole motor to reduce a frequency of motor stalls of the downhole motor.

20 Claims, 3 Drawing Sheets

DEVICES, SYSTEMS, AND METHODS FOR MITIGATING DOWNHOLE MOTOR DYSFUNCTION

CROSS-REFERENCE TO RELATED APPLICATIONS

The present application claims priority to and the benefit of U.S. Provisional Patent Application Ser. No. 63/379,929, filed Oct. 18, 2022, the disclosure of which is incorporated herein by reference in its entirety.

BACKGROUND

Downhole drilling systems may utilize a downhole motor to generate mechanical power and/or electricity. The downhole motor may include a rotor rotated by drilling fluid. During operation, the rotation of the rotor may stop in a stall and/or a series of micro stalls.

SUMMARY

In some embodiments, the techniques described herein relate to a method for mitigating motor stall. The method includes determining a change in motor torque of a downhole motor based on a flow of a drilling fluid through the downhole motor. A change in bit torque of a bit with respect to a change in a weight on bit of the bit is determined. Based at least in part on the change in motor pressure and the change in bit torque of the bit with respect to the change in the weight on bit of the bit, a flow rate of the drilling fluid through the downhole motor is adjusted to reduce a frequency of motor stalls of the downhole motor.

In some embodiments, the techniques described herein relate to a method for mitigating motor stall. The method includes flowing a drilling fluid through a motor with a flow rate. A stability metric is determined based at least in part on the flow rate, a motor change in torque with respect to a change in pressure of the motor and a bit change in torque with respect to a change in weight on bit of a bit. If the stability metric is above a threshold stability metric, a flow rate of a fluid flow is adjusted.

In some embodiments, the techniques described herein relate to a method for designing a downhole motor. The method includes determining a bit aggressivity of a bit, the bit aggressivity being a relationship between a change in torque with respect to a change in weight on the bit. An inlet area of the downhole motor is determined. Based at least in part on the inlet area and the bit aggressivity, a motor speed with a speed to flow rate parameter is selected. The speed to flow rate parameter of the motor is selected to mitigate a stall condition of the downhole motor.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
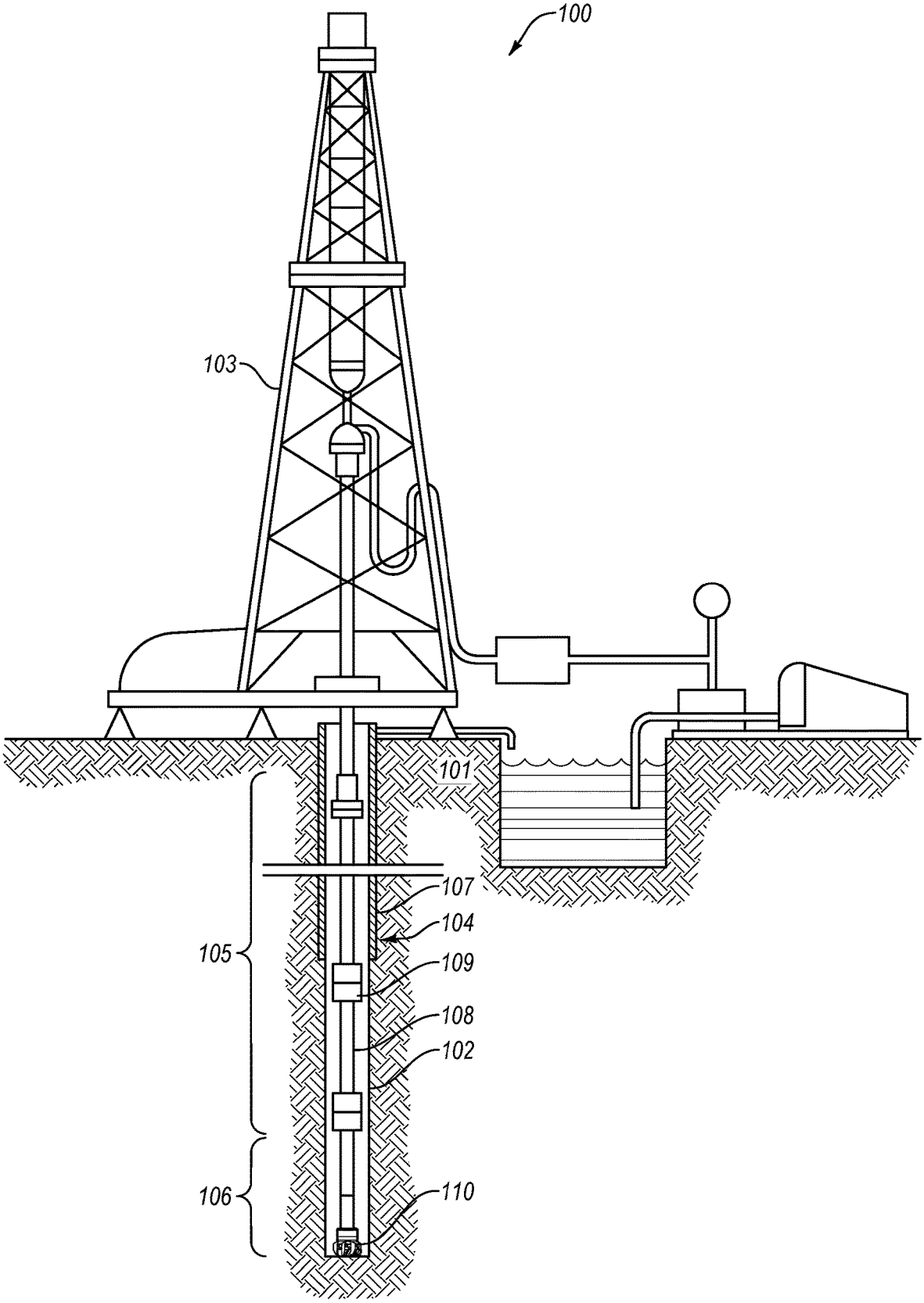
FIG. 1 shows one example of a drilling system for drilling an earth formation to form a wellbore, according to at least one embodiment of the present disclosure.

This disclosure generally relates to devices, systems, and methods for mitigating a stall condition of a downhole motor. A mud motor couples hydraulic power (flow and pressure drop) into mechanical power. This results in fluid pressure coupling to torque and torque coupling to differential pressure. Differential pressure across the motor also generates an axial force which is reacted as weight at the bit. This weight at the bit may also couple back to torque. The interplay of these elements may result in instability in the drilling system. This instability may result in drilling dysfunctions, such as motor stall, catastrophic motor stall, micro stalls in the motor, motor coupled stick slip, and high frequency torsional oscillations ("HFTO").

In accordance with at least one embodiment of the present disclosure, a stability model may generate a relationship between these elements. Using the stability model, a drilling system may adjust the flow rate of the drilling fluid through the downhole motor to reduce or eliminate stalling in the motor. For example, the stability model may determine a stability metric based on a bit aggressivity of the bit, a motor speed with respect to flow rate of the downhole motor, and a cross-sectional area (e.g., an inlet area) of an inlet to the downhole motor. If the stability metric of the system is below a stability threshold, then the motor may be stable at anticipated flow rates. If the stability metric is above a stability threshold, then the motor may be stable below a threshold flow rate.

The drilling operator may use the stability metric to select and operate the downhole motor. For example, the drilling operator may use the stability metric to select a specific motor with the characteristic(s) to satisfy the stability metric. Additionally, or alternatively, the drilling operator may use the criteria to determine a flow rate of the downhole motor. In some examples, the stability metric may be used to determine the maximum flow rate at which the downhole motor may be operated to reduce or prevent stall in the downhole motor. The stability metric may be incorporated into a feedback loop downhole to maintain a flowrate across the downhole motor. For example, the flow rate may be automatically adjusted at the downhole tool. In some embodiments, the stability metrics and/or the elements used to determine the stability metric may be transmitted uphole to a surface location. The flow rate through the motor may be adjusted at the surface location. For example, the drilling operator may adjust the flow rate of the drilling fluid by adjusting the operation of the drilling fluid pumps at the surface.

In some embodiments, the stability metric may be used to size bit parameters and/or downhole motor parameters. For example, for a given bit aggressivity and cross-sectional area of the inlet (e.g., inlet area), the motor speed to flow rate parameter of the downhole motor may be selected. In some embodiments, the motor speed to flow rate parameter may be selected to operate without stalling at any flow rate. In some embodiments, the motor speed may be selected to operate without stalling within a desired or anticipated flow range. In this manner, wear on the bit and/or the downhole tool may be reduced, thereby improving operation of the downhole tool.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system ("RSS"). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

The BHA 106 may include a downhole motor. The downhole motor may include any type of downhole motor. For example, the downhole motor may include a positive displacement pump. Drilling fluid passing through the downhole motor may cause a rotor to rotate. Rotation of the rotor may generate mechanical power and/or electricity, which may be used to power other elements of the BHA 106.

During operation, the downhole motor may enter a stall condition. In a stall condition, the rotor of the downhole motor may stop rotating. This may increase the motor pressure uphole of the motor (e.g., uphole motor pressure). In some embodiments, a stall condition of the downhole motor may damage the motor. In some embodiments, a stall condition of the downhole motor may damage the bit and/or other downhole tool connected to the downhole motor.

In accordance with at least one embodiment of the present disclosure, a drilling operator may determine a stability metric for the downhole motor. Using the stability metric, the drilling operator may mitigate and/or eliminate a stall condition in the downhole motor. For example, using the stability metric, the drilling operator may adjust the flow rate of the drilling fluid flowing through the downhole motor. In some examples, using the stability metric, the drilling operator may select one or more bit parameters and/or downhole motor parameters. For example, the drilling operator may select a bit aggressivity of the bit. In some examples, the drilling operator may select a motor speed of the motor.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
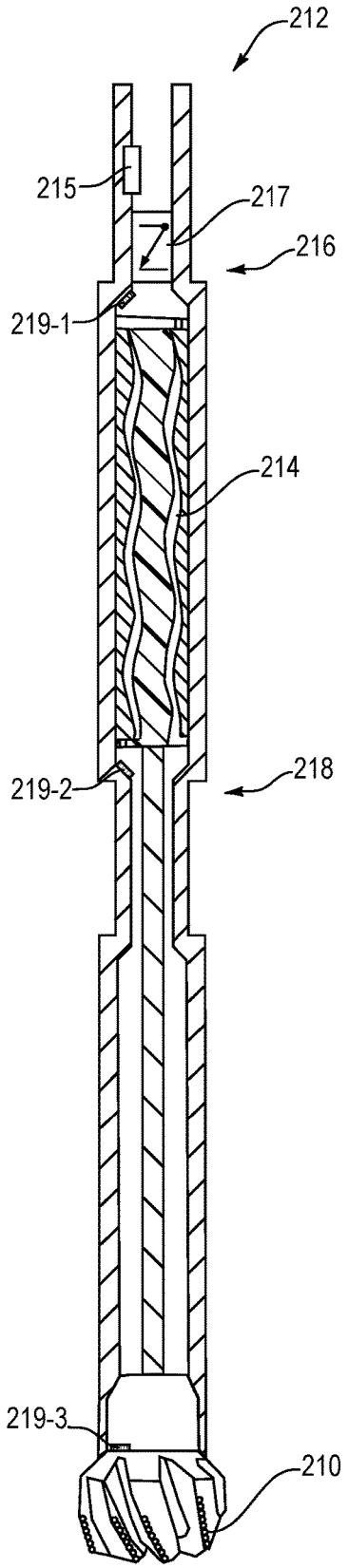
FIG. 2 is a partial cross-sectional of a downhole motor system, according to at least one embodiment of the present disclosure.

FIG. 2 is a partial cross-sectional view of a downhole motor system 212, according to at least one embodiment of the present disclosure. The downhole motor system 212 includes a downhole motor 214 including an inlet 216 and an outlet 218. Drilling fluid may flow with a flow rate through the inlet 216 and into the downhole motor 214. The fluid flow of the drilling fluid may cause the rotor of the downhole motor 214 to rotate, thereby generating mechanical power and/or electricity at the downhole motor system 212. Fluid that passes through the outlet 218 may pass to a bit 210 or other downhole tool.

As discussed herein, pressure coupled motor system instabilities may result in one or more drilling system dysfunctions. For example, one dysfunction may include HFTO at frequencies in the range 50-80 Hz or higher. In some examples, a dysfunction may include stick-slip type instabilities in the range 0.5 to 2 Hz. in some examples, a dysfunction may include a stall condition, such as micro stalls (e.g., a stall that may take several seconds to resolve) and full isolated catastrophic stall.

The stability of the downhole motor system 212 may be modeled with a stability model. The stability model may include a bit aggressivity $k_b$, which may be modeled as:

$$\frac{dT_B}{dWOB} = k_B \qquad \text{Eq. 1}$$

where $dT_B$ is the change in torque at the bit and dWOB is the change in weight at the bit. The bit aggressivity may be determined from the bit modelling at the surface. In some embodiments, $dT_B$ and dWOB may be determined from measurements collected downhole or, among other derivations, may be calculated as part of the design of the bit or other downhole tool. The bit aggressivity may be a representation of the amount of material removed for a given combination of torque and WOB. For example, for a given torque and WOB, a bit having a high bit aggressivity may remove more material than a bit having a low bit aggressivity. A bit having a high aggressivity may be associated with greater wear and/or erosion on the bit than a bit having a relatively lower aggressivity when drilling under the same torque and WOB and formation conditions.

The stability model may include a motor speed $k_m$, which may be modeled as:

$$\frac{dP_m}{dT_m} = \frac{1}{k_M} \quad \text{Eq. 2}$$

where $dP_m$ is the pressure drop of the motor and $dT_m$ is the change in torque at the motor. $k_m$ may be the slope of the motor pressure-torque curve in the motor specification. In some embodiments, the motor speed may be a property of the motor. If there is no change in the axial strain in the collar above the motor, then the cross-sectional area above the motor may be expressed as:

$$\frac{dWOB}{dP_c} = A_m \quad \text{Eq. 3}$$

where $P_c$ is the pressure above the motor and $A_m$ is the cross-sectional area at the top of the motor. The pressure above the motor can be simplified and written as:

$$P_c = P_m + P_b \quad \text{Eq. 4}$$

where $P_b$ is the pressure drop across the bit. $P_b$ may be written as:

$$P_b = k_h \rho Q^2 \quad \text{Eq. 5}$$

where $k_h$ is the pressure drop at the nozzles, ρ is the drilling fluid density, and Q is the flow rate of the drilling fluid.

In some embodiments, for rapid changes in pressure which are faster than the acoustic round trip time (e.g., the time a pressure wave in the drilling fluid takes to travel to the surface and back to the motor), the water hammer model may be applied. This may result in:

$$\Delta P = \rho C \Delta V \quad \text{Eq. 6}$$

where C is the sound speed of the mud and V the mud velocity. This may be determined in the drill pipe, which may be an appropriate acoustic dwell for the wave.

Using Eq. 1 through Eq. 6, an example stability metric for a downhole motor system 212 may be expressed as:

$$\frac{1}{\left(1 + \frac{2\rho k_h Q A_p}{C}\right)} \frac{k_B A_m}{k_M} < S_T \quad \text{Eq. 7}$$

where $S_T$ is a stability threshold. Using the stability metric of Eq. 7, the stability of the downhole motor system 212 may be determined. For example, if the stability metric on the left hand of Eq. 7 is less than the stability threshold, then the downhole motor system 212 may be stable. If the stability metric on the left hand of Eq. 7 is greater than the stability threshold, then the downhole motor system 212 may not be stable, and one or more variables may be changed to improve the stability of the downhole motor system 212.

In some embodiments, the stability threshold may be the threshold at which motor speed, with the associated mechanical power and/or electricity generation, may be balanced with the risk of the dysfunctions discussed herein, such as motor stall. The stability threshold may be set at a particular value based on a desired wear and/or performance tolerance for the downhole drilling system. A higher stability threshold may be associated with higher performance of the downhole motor 214 and an associated higher risk of damage due to the dysfunctions discussed herein. A lower stability threshold may be associated with a lower performance of the downhole motor 214 and an associated lower risk of damage due to the dysfunctions discussed herein. In some embodiments, when the stability threshold is equal to or less than 1, then the downhole motor 214 may operate at any flow rate Q with little risk of stalling or other dysfunctions. In some embodiments, when the stability threshold is greater than 1, then the downhole motor 214 may operate within a range of flow rates Q. Above a threshold flow rate Q, when the stability threshold is greater than 1, the downhole motor 214 may experience one or more of the dysfunctions discussed herein.

In accordance with at least one embodiment of the present disclosure, the stability threshold may be set in any manner. For example, the stability threshold may be set by the drilling operator based on the risk tolerance of the drilling operator. In some examples, the stability threshold may be set by the drilling operator based on drilling targets (such as drilling rate targets). In some examples, the stability threshold may be set by the operator based on a reliability of the downhole motor. In some examples, the stability threshold may be set through analysis of empirical data, such as an analysis of offset wellbores using the same or similar equipment in the same or similar drilling conditions.

In some embodiments, the flow rate may be at least partially determined based on the stability metric. Eq. 7 may be rearranged as:

$$Q > \frac{C(k_B A_m / k_M - 1)}{2\rho k_h A_p} \quad \text{Eq. 8}$$

A drilling operator may use Eq. 8 to monitor the flow rate with respect to the stability metric. If the flow rate on the left hand of Eq. 8 exceeds the calculated stability metric on the right hand of Eq. 8, then instabilities may be introduced into the downhole motor 214. In this manner, the drilling operator may adjust the flow rate Q based on the stability metric. For example, the drilling operator may monitor the values of the stability metric. As the values of the stability metric change, the drilling operator may adjust the flow rate Q to maintain the stability of the downhole motor 214.

In some embodiments, the drilling operator may adjust other parameters of Eq. 7 and/or Eq. 8. For example, the downhole motor 214 may include a choke valve 217 at the inlet 216. The choke valve may have a variable or adjustable diameter or opening. Adjusting the choke valve may result in an adjusted cross-sectional area of the area of the inlet above the downhole motor. The adjusted cross-sectional area may be measured and the flow rate may be adjusted based, at least in part, on the adjusted cross-sectional area. In some embodiments, the variable diameter or other size of the choke valve may be changed based on the stability metric to maintain stability in the downhole motor 214 while optionally maximizing the motor speed and power output of the downhole motor 214. In some embodiments, the stability metric may be changed based on other factors, such as a change in drilling fluid properties, based on a change in formation, and/or based on drilling activities.

In some embodiments, the stability metric may be used during bit and/or downhole motor design. For example, during wellbore design, a drilling operator may design the bit 210 and/or the downhole motor 214 based on the stability metric. The drilling operator may receive the bit aggressivity from the bit manufacturer. In some embodiments, the drilling operator may measure and/or determine the bit aggressivity using an existing bit. The drilling operator may know the cross-sectional area of the inlet to the downhole motor 214. The motor speed may be known to the motor manufacturer and/or may be measured by the operator. In this manner, and based on the other known parameters of a planned wellbore, the drilling operator may adjust one or more of the bit aggressivity, the motor speed, and/or the cross-sectional area of the inlet to attain a desired stability metric value and/or stay within a desired stability threshold.

To determine various parameters, including flow rate, torque, pressure, pressure drop, weight, etc. one or more sensors 219-1, 219-2, 219-3, etc. (collectively sensors 219) may be deployed in the downhole motor system 212. In FIG. 2, for instance, a sensor 219-1 is deployed above the downhole motor 214 (e.g., at or near the inlet 216), a sensor 219-2 is deployed below the downhole motor 214 (e.g., at or near the outlet 218), and a sensor 219-3 is deployed at or near the bit 210. One or more of the sensors 219 may be in communication with a downhole component 215 used to facilitate interpretation and/or use of the measurements of the sensors 219. For instance, the downhole component 215 may include a processor and/or control to use measurements of the sensors 219, interpret sensor data, or control the choke valve 217 or other downhole element. Additionally or alternatively, the downhole component 215 may include communications capability to use electromagnetic, acoustic, mud pulse, or other methods to communicate with other tools in a BHA or the surface. The surface or downhole tools may then transmit information or control instructions to the downhole component 215, receive information or control instructions from the downhole component 215, or a combination thereof.

Figure 3:
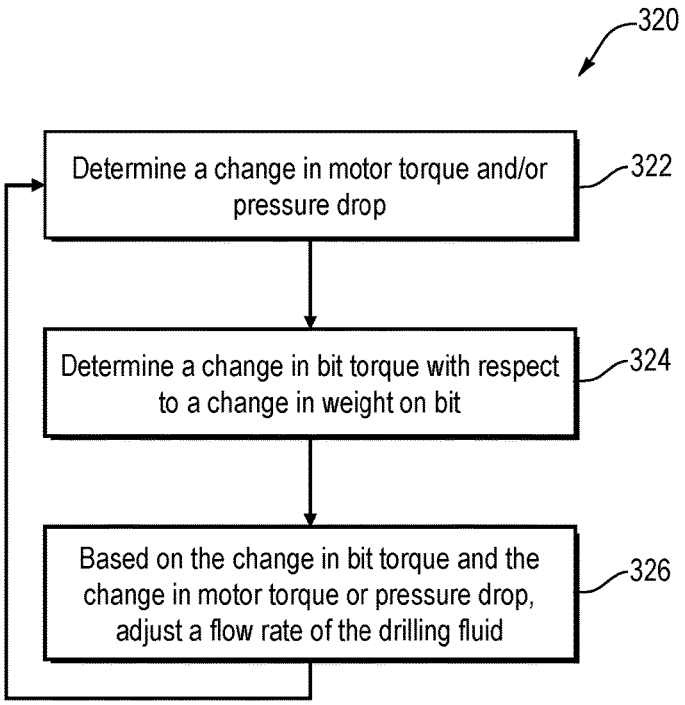
FIG. 3 is a flowchart of a method for mitigating motor stall, according to at least one embodiment of the present disclosure.
Figure 4:
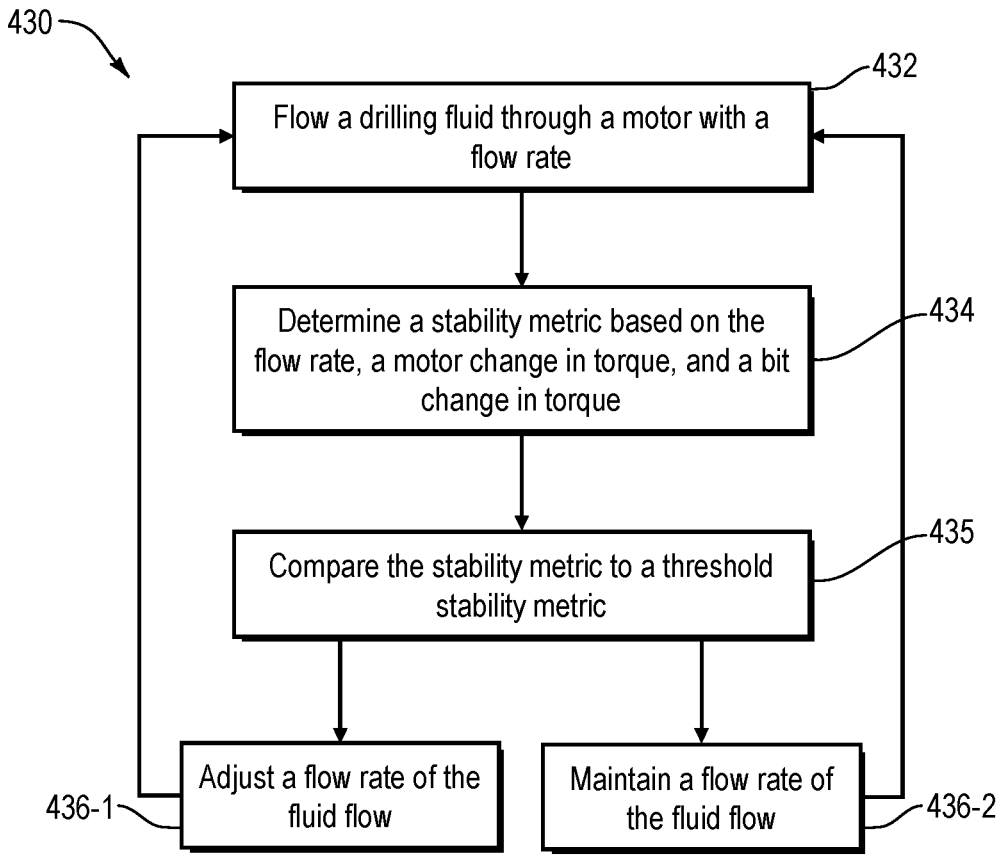
FIG. 4 is a flowchart of a method for mitigating motor stall, according to at least one embodiment of the present disclosure.
Figure 5:
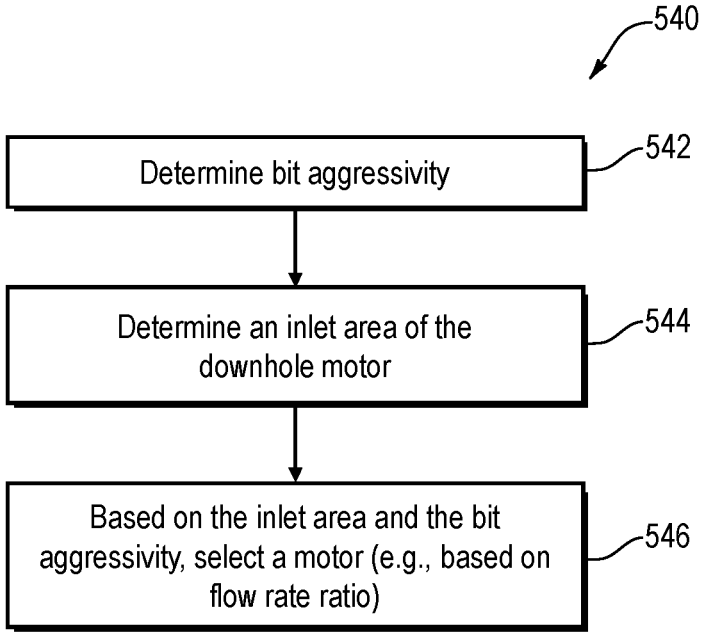
FIG. 5 is a flowchart of a method for designing a downhole motor, according to at least one embodiment of the present disclosure.

FIG. 3-5, the corresponding text, and the examples provide a number of different methods, systems, devices, and computer-readable media of the downhole motor system 212, according to at least one embodiment of the present disclosure. In addition to the foregoing, one or more embodiments can also be described in terms of flowcharts including acts for accomplishing a particular result, as shown in FIG. 3-5. FIG. 3-5 may be performed with more or fewer acts. Further, the acts may be performed in differing orders. Additionally, the acts described herein may be repeated or performed in parallel with one another or parallel with different instances of the same or similar acts.

As mentioned, FIG. 3 illustrates a flowchart of a series of acts for a method 320 for mitigating motor stall, in accordance with at least one embodiment of the present disclosure. While FIG. 3 illustrates acts according to one embodiment, alternative embodiments may omit, add to, reorder, and/or modify any of the acts shown in FIG. 3. The acts of FIG. 3 can be performed as part of a method. Additionally or alternatively, a computer-readable medium can include instructions that, when executed by one or more processors, cause a computing device to perform the acts of FIG. 3. In some embodiments, a system can perform the acts of FIG. 3. In some embodiments, the acts of FIG. 3 may be performed downhole. For example, the acts of FIG. 3 may be performed at a BHA or other downhole tool. In some embodiments, the acts of FIG. 3 may be performed at a surface location. For example, the acts of FIG. 3 may be performed using a drill rig network at the drill rig 103 from FIG. 1.

The method 320 may include determining a change in motor toque and/or motor pressure drop at 322. The change in motor torque or motor pressure drop may, for instance, be measured based on a flow of a drilling fluid through a downhole motor. For example, a flow-rate sensor may measure the flow rate of the fluid flow of the drilling fluid through the downhole motor. Additionally, or alternatively, the flow of the drilling fluid through the downhole motor can be estimated from the flow through the surface pumps. In some embodiments, the motor torque may be measured using a torque sensor on the rotor of the downhole motor. Similarly, a pressure drop may be measured by using a set of sensors above and below the downhole motor. Additionally, or alternatively, the pressure drop may be estimated, for instance, by using design parameters of the downhole motor with the measured or estimated flow rate.

A change in bit torque of a bit with respect to a change in weight on bit of the bit may be determined at 324. In some embodiments, the bit torque may be directly measured using sensors on the bit. In some embodiments, the bit torque may be inferred using other measurements and/or the configuration of the bit.

In some embodiments, and based at least in part on the change in motor pressure and the change in bit torque of the bit with respect to the change in the weight on bit of the bit, the flow rate may be adjusted through the downhole motor at 326. In some embodiments, adjusting the flow rate may reduce a frequency of motor stalls of the downhole motor. This may help to reduce the damage to the downhole drilling system, such as the downhole motor and/or the bit.

In some embodiments, the acts of FIG. 3 may be repeated or looped. For example, after adjusting the flow rate, the drilling system may continue to monitor torque on the motor and/or the change in bit torque of the bit. Based on these monitored values, the drilling system may continue to monitor the status of the motor and the bit to maintain the stability of the downhole motor.

As mentioned, FIG. 4 illustrates a flowchart of a series of acts for a method 430 for mitigating motor stall, in accordance with at least one embodiment of the present disclosure. While FIG. 4 illustrates acts according to one embodiment, alternative embodiments may omit, add to, reorder, and/or modify any of the acts shown in FIG. 4. The acts of FIG. 4 can be performed as part of a method. Additionally, or alternatively, a computer-readable medium can include instructions that, when executed by one or more processors, cause a computing device to perform some or each of the acts of FIG. 4. In some embodiments, a system can perform the acts of FIG. 4. In some embodiments, the acts of FIG. 4 may be performed downhole. For example, the acts of FIG. 4 may be performed at or by a BHA or other downhole tool. In some embodiments, the acts of FIG. 4 may be performed at a surface location. For example, the acts of FIG. 4 may be performed using a drill rig network at the drill rig 103 from FIG. 1.

The method may include flowing a drilling fluid through a downhole motor with a flow rate at 432. A drilling system may determine a stability metric based at least in part on the flow rate, a motor change in torque, and a bit change in torque at 434. In some embodiments, the motor change in torque may be determined with respect to a change in pressure or pressure drop of the motor, or the change in pressure or pressure drop of the motor may be used in lieu of the change in torque of the motor. The bit change in torque may be determined with respect to a change in weight on bit of a bit. A comparison can be made between the stability metric and a threshold stability metric at 435. Based on the stability metric, the fluid flow rate of the fluid flow may be adjusted at 436-1 or maintained at 436-2. For instance, when the stability metric is above the threshold stability metric, the fluid flow rate may be adjusted (e.g., decreased or increased) at 436-1, and when below the stability metric, the fluid flow rate may be maintained at 436-2. In another example, when the stability metric is above or below the threshold stability metric, the fluid flow rate may be adjusted at 436-1. In an illustrative case, the fluid flow rate may be decreased when the stability metric is above the threshold stability metric and/or increased when the stability metric is below the threshold stability metric. In still another example, the stability metric may include a tolerance, thus defining a threshold stability metric range. When the stability metric is within the threshold stability metric range, the flow rate of the fluid flow may be maintained at 436-2. When the stability metric is outside the threshold stability metric range, the flow rate of the fluid flow may be adjusted at 436-1. Optionally, and as noted above, the type of adjustment (e.g., fluid flow decrease or increase) may be dependent upon whether the stability metric is above or below the threshold stability metric range. Such adjustments to the flow rate of the fluid flow may help to reduce dysfunctions and/or stalls of the drilling system while also optimizing motor performance.

In some embodiments, the acts of FIG. 4 may be repeated or looped. For example, after adjusting the flow rate, or after determining the flow rate is to be maintained, the drilling system may continue to flow drilling fluid through the motor and monitor torque on the motor and/or the change in bit torque of the bit. Based on these monitored values, the drilling system may continue to monitor the status of the motor and the bit to maintain the stability of the downhole motor.

FIG. 5 illustrates a flowchart of a series of acts for a method 540 for designing a drilling system in accordance with at least one embodiment of the present disclosure. While FIG. 5 illustrates acts according to one embodiment, alternative embodiments may omit, add to, reorder, and/or modify any of the acts shown in FIG. 5. The acts of FIG. 5 can be performed as part of a method. Additionally, or alternatively, a computer-readable medium can include instructions that, when executed by one or more processors, cause a computing device to perform the acts of FIG. 5. In some embodiments, a system can perform the acts of FIG. 5. In some embodiments, the acts of FIG. 5 may be performed downhole. For example, the acts of FIG. 5 may be performed at a BHA or other downhole tool. In some embodiments, the acts of FIG. 5 may be performed at a surface location. For example, the acts of FIG. 5 may be performed using a drill rig network at the drill rig 103 from FIG. 1.

In some embodiments, a drilling operator may determine a bit aggressivity of a bit at 542. The bit aggressivity may be a relationship between a change in torque with respect to a change in weight on the bit. The drilling operator or other system may determine an inlet area of the downhole motor at 544. Based at least in part on the inlet area and the bit aggressivity, the drilling operator may select a motor (e.g., motor type, motor design) with a speed to flow rate parameter of the downhole motor at 546. In some embodiments, the motor speed may be determined with respect to a change in motor pressure and torque. In some embodiments, the motor speed to flow rate parameter may be a property of the motor. For example, a motor manufacturer may prepare charts, formulas, or other mechanisms that describe the motor speed with respect to flow rate. A drilling operator may review the manufacturer-prepared specifications for the motor and select a motor speed to flow rate parameter. In some embodiments, the drilling operator may determine a motor speed to flow rate parameter by measuring the rotational rate of the rotor of the motor at various flow rates. In some embodiments, the manufacturer and/or the drilling operator may measure the torque on the rotor associated with the rotational rate and the flow rate. This may help the drilling operator to determine the mechanical power and/or electricity generated at various flow rates.

The motor speed to flow rate parameter may be selected to mitigate a stall condition of the downhole motor. The motor speed to flow rate parameter may, in some cases, be referred to as a motor speed, although the parameter may not have traditional velocity units. For instance, a motor speed may have units of revolutions per flow rate (e.g., having units of revolutions/gallon or revolutions/$m^3$), and is thus also described herein as a motor speed with respect to flow rate, or as a motor speed to flow rate parameter.

In some embodiments, the method may include installing the downhole motor having the motor speed in a bottomhole assembly having the bit. In some embodiments, the method may include installing the bit on the bottomhole assembly having the downhole motor.

In some embodiments, the methods of the present disclosure may be executed by a computing system. For instance, a computing system may include a computer or computer system that is an individual computer system or an arrangement of distributed computer systems. The computer system can include one or more analysis modules that are configured to perform various tasks according to some embodiments, such as one or more methods disclosed herein. Example modules or computing systems may be in the form of special-purpose downhole tools (e.g., sensor packages, downhole controllers), or surface equipment. To perform these various tasks, the analysis module executes independently, or in coordination with, one or more processors, which are connected to one or more computer-readable media. The processors are optionally connected to a network interface to allow the computer system to communicate over a data network with one or more additional computer systems and/or cloud computing systems that may or may not share the same architecture, and may be located in different physical locations. For instance, one computer system may be located in downhole equipment, an alternative or additional computer system may be on a rig or wellbore surface, another may be in another downhole tool or a control facility, another may be in a cloud-computing facility or data center, and another may be located in varying countries on different continents.

A processor may include a microprocessor, microcontroller, processor module or subsystem, programmable integrated circuit, programmable gate array, or another control or computing device. Additionally, while computer-readable media may be within a computer system, in some embodiments, computer-readable media may be distributed within and/or across multiple internal and/or external enclosures of a computing system and/or additional computing systems. The computer-readable media may be implemented as one or more computer-readable or machine-readable storage media, transmission media, or a combination of storage and transmission media.

As used herein, "storage media", "computer-readable storage media," and the like refer to physical media that stores software instructions in the form of computer-readable program code that allows performance of embodiments of the present disclosure. "Transmission media", "computer-readable transmission media," and the like refer to non-physical media which carry software instructions in the form of computer-readable program code that allows performance of embodiments of the present disclosure. Thus, by way of example, and not limitation, embodiments of the present disclosure can include at least two distinct and different kinds of computer-readable media, namely computer-readable storage media and/or computer-readable transmission media. Combinations of computer-readable storage media and computer-readable transmission media should be included within the scope of computer-readable media.

To further illustrate the distinct nature of computer-readable storage media and computer-readable transmission media, computer-readable storage media may include one or more different forms of memory and storage including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or solid state drives, or other types of storage devices.

Transmission media may conversely include communications networks or other data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can therefore include a communication network and/or data links, carrier waves, wireless signals, and the like, which can be used to carry desired program, code means, or instructions.

Note that the instructions discussed above may be provided on one computer-readable or machine-readable medium, or may be provided on multiple computer-readable or machine-readable media distributed in a large system having possibly plural nodes. Such computer-readable or machine-readable media are considered to be part of an article of manufacture. An article of manufacture may refer to any manufactured single component or multiple components. The computer-readable media may be located either in the machine running the machine-readable instructions, or located at a remote site from which machine-readable instructions may be downloaded or accessed over a network for execution. Further, where computer-readable transmission media is used, upon reaching various computing system components, program code in the form of computer-executable instructions or data structures can be transferred automatically or manually from computer-readable transmission media to computer-readable storage media (or vice versa). For example, computer-executable instructions or data structures received over a network or data link can be buffered in memory-type storage media (e.g., RAM) within a network interface module (NIC), and then eventually transferred to computer system RAM and/or to less volatile storage media (e.g., a hard drive) at a computer system. Thus, it should be understood that computer-readable storage media can be included in computer system components that also (or even primarily) utilize computer-readable transmission media.

It should be appreciated that described computing systems are merely examples of computing systems, and that a computing system may have more or fewer components than described, may combine additional components not described, or may have a different configuration or arrangement of the components. The various components of a computing system may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Embodiments of a downhole motor system have been primarily described with reference to wellbore drilling operations; however, the downhole motor system described herein may be used in applications other than the drilling of a wellbore. In other embodiments, downhole motor systems according to the present disclosure may be used outside a wellbore or other downhole environment used for the exploration or production of natural resources. For instance, downhole motor systems of the present disclosure may be used in a borehole used for placement of utility lines, or a similar system may operate as a pump (e.g., for artificial lift purposes), as a hydraulic motor in a machining or manufacturing industry, or in other applications. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. For instance, a stability metric may be inverted, in which case a determination of whether the stability metric is below a threshold stability metric should be considered equivalent to determining whether the non-inverted stability metric exceeds a threshold stability metric. Further, equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for mitigating motor stall, comprising:

determining a sound speed of a drilling fluid;

determining a motor speed based on at least one of a motor change in torque or a motor pressure drop of a downhole motor using a flow of the drilling fluid through the downhole motor;

determining a bit aggressivity based on a change in bit torque of a bit with respect to a change in a weight on bit of the bit;

determining a stability metric as a function of at least the sound speed of the drilling fluid, the motor speed, and the bit aggressivity;

determining that the stability metric is above a threshold stability metric, and decreasing a flow rate of the drilling fluid through the downhole motor to reduce the stability metric and reduce a frequency of motor stalls of the downhole motor; and determining that the stability metric is below the threshold stability metric, and increasing the flow rate of the drilling fluid through the downhole motor.

2. The method of claim 1, further comprising:

determining a change in motor pressure of the downhole motor based on the flow of the drilling fluid through the downhole motor.

3. The method of claim 1, further comprising:

determining the flow rate of the drilling fluid, wherein determining the stability metric comprises determining the stability metric as a function of at least the sound speed of the drilling fluid, the motor speed, the bit aggressivity, and the flow rate of the drilling fluid.

4. The method of claim 1, further comprising:

determining a cross-sectional area of an inlet above the downhole motor, wherein determining the stability metric comprises determining the stability metric as a function of at least the sound speed of the drilling fluid, the motor speed, the bit aggressivity, and the cross-sectional area.

5. The method of claim 4, further comprising:

adjusting the cross-sectional area of the inlet above the downhole motor to an adjusted cross-sectional area;

determining the adjusted cross-sectional area; and adjusting the flow rate based at least in part on the adjusted cross-sectional area.

6. The method of claim 1, further comprising:

determining a density of the drilling fluid, wherein determining the stability metric comprises determining the stability metric as a function of at least the sound speed of the drilling fluid, the motor speed, the bit aggressivity, and the density of the drilling fluid, wherein determining the stability metric accounts for pressure changes occurring faster than an acoustic round trip time for a pressure wave in the drilling fluid to travel from the downhole motor to a surface location and back to the downhole motor, wherein the pressure changes are based on an equation:

$$\Delta P = \rho C \Delta V$$

wherein $\Delta P$ is a change in pressure of the drilling fluid, $\rho$ is the density of the drilling fluid, C is the sound speed of the drilling fluid, $\Delta V$ is a change in velocity of the drilling fluid.

7. The method of claim 1, further comprising:

determining a cross-sectional area of an inlet above the downhole motor;

determining a density of the drilling fluid; and determining the flow rate of the drilling fluid, wherein determining the stability metric comprises determining the stability metric as a function of at least the sound speed of the drilling fluid, the motor speed, the bit aggressivity, the cross-sectional area, the density of the drilling fluid, and the flow rate of the drilling fluid.

8. The method of claim 7, further comprising:

determining a nozzle pressure drop across a nozzle of the bit, wherein determining the stability metric comprises determining the stability metric as a function of at least the sound speed of the drilling fluid, the motor speed, the bit aggressivity, the cross-sectional area, the density of the drilling fluid, the flow rate of the drilling fluid, and the nozzle pressure drop.

9. The method of claim 8, wherein the stability metric is calculated using an equation:

$$\frac{1}{\left(1+\frac{2\rho k_h Q A_p}{C}\right)}\frac{k_B A_m}{k_M} < S_T$$

wherein ST is the stability metric, Q is the flow rate of the drilling fluid, C is the sound speed of the drilling fluid, ρ is the density of the drilling fluid, $k_h$ is the nozzle pressure drop across the nozzle of the bit, $A_m$ is the cross-sectional area at the inlet above the downhole motor, $k_m$ is the motor speed, $k_B$ is the bit aggressivity, and Ap is an area of a drill pipe.

10. The method of claim 1, further comprising:

determining that the stability metric is below the threshold stability metric at a first time, and increasing the flow rate of the drilling fluid through the downhole motor; and determining that the stability metric is below the threshold stability metric at a second time different from the first time, and maintaining the flow rate of the drilling fluid through the downhole motor.

11. A method for mitigating motor stall, comprising:

flowing a drilling fluid through a motor with a flow rate;

determining a stability metric as a function of at least the flow rate, a motor change in torque with respect to a change in pressure of the motor, a change in bit torque of a bit with respect to a change in a weight on bit of the bit, a sound speed of the drilling fluid, and a density of the drilling fluid;

comparing the stability metric with a threshold stability metric to obtain a comparison indicating an instable condition or a stable condition of the motor; and adjusting the flow rate of the drilling fluid through the motor in response to the comparison, wherein adjusting the flow rate comprises:

decreasing the flow rate through the motor in response to the comparison indicating the instable condition of the motor; and increasing the flow rate through the motor in response to the comparison indicating the stable condition of the motor.

12. The method of claim 11, wherein adjusting the flow rate includes automatically adjusting the flow rate at a downhole tool.

13. The method of claim 12, wherein adjusting the flow rate at the downhole tool includes activating a choke valve that reduces the flow rate at the downhole tool for decreasing the flow rate through the motor in response to the comparison indicating the instable condition of the motor.

14. The method of claim 11, further comprising:

transmitting the stability metric to a surface location and wherein adjusting the flow rate includes reducing the flow rate from the surface location for decreasing the flow rate through the motor in response to the comparison indicating the instable condition of the motor.

15. The method of claim 11, further comprising:

determining the instable condition based on the comparison indicating the stability metric being greater than the threshold stability metric;

decreasing the flow rate through the motor based on the stability metric being greater than the threshold stability metric;

determining the stable condition based on the comparison indicating the stability metric being less than the threshold stability metric; and increasing the flow rate through the motor based on the stability metric being less than the threshold stability metric.

16. The method of claim 11, further comprising:

determining the instable condition based on the comparison indicating the stability metric being outside a range of the threshold stability metric;

decreasing the flow rate through the motor based on the stability metric being outside the range of the threshold stability metric;

determining the stable condition based on the comparison indicating the stability metric being within the range of the threshold stability metric;

maintaining the flow rate through the motor based on the stability metric being within the range of the threshold stability metric.

17. The method of claim 11, further comprising:

determining a cross-sectional area of an inlet of a top portion of the motor; and determining a nozzle pressure drop across a nozzle of the bit, wherein determining the stability metric comprises determining the stability metric as a function of at least the flow rate, the motor change in torque with respect to the change in pressure of the motor, the change in bit torque of the bit with respect to the change in the weight on bit of the bit, the sound speed of the drilling fluid, the density of the drilling fluid, the cross-sectional area, and the nozzle pressure drop.

18. The method of claim 17, wherein determining the stability metric comprises determining:

a motor speed based on the motor change in torque with respect to the change in pressure of the motor; and a bit aggressivity based on the change in bit torque of the bit with respect to the change in the weight on bit of the bit.

19. The method of claim 18, wherein the stability metric is calculated using an equation:

$$\frac{1}{\left(1+\frac{2\rho k_h Q A_p}{C}\right)}\frac{k_B A_m}{k_M} < S_T$$

wherein ST is the stability metric, Q is the flow rate of the drilling fluid, C is the sound speed of the drilling fluid, ρ is the density of the drilling fluid, $k_h$ is the nozzle pressure drop across the nozzle of the bit, $A_m$ is the cross-sectional area at the inlet at the top portion of the motor, $k_m$ is the motor speed, $k_B$ is the bit aggressivity, and Ap is an area of a drill pipe.

20. The method of claim 11, further comprising:

increasing the flow rate through the motor in response to the comparison indicating the stable condition of the motor at a first time; and maintaining the flow rate through the motor in response to the comparison indicating the stable condition of the motor at a second time different from the first time.

* * * * *